US007731189B2

(12) United States Patent
Kuo et al.

(10) Patent No.: US 7,731,189 B2
(45) Date of Patent: Jun. 8, 2010

(54) PAPER GUIDE ADJUSTING MECHANISM AND OFFICE MACHINE USING SUCH MECHANISM

(75) Inventors: Ping-Hung Kuo, Taoyuan Hsien (TW); Ke-Wei Chen, Taoyuan Hsien (TW); Cheng-Ming Liao, Taoyuan Hsien (TW); Chien-Min Chen, Taoyuan Hsien (TW)

(73) Assignee: Teco Image Systems Co., Ltd., Taoyuan Hsien (TW)

( * ) Notice: Subject to any disclaimer, the term of this patent is extended or adjusted under 35 U.S.C. 154(b) by 282 days.

(21) Appl. No.: 12/013,140

(22) Filed: Jan. 11, 2008

(65) Prior Publication Data

US 2009/0085276 A1 Apr. 2, 2009

(30) Foreign Application Priority Data

Sep. 28, 2007 (TW) ..... 96136194 A

(51) Int. Cl.
*B65H 5/02* (2006.01)

(52) U.S. Cl. ..... 271/274; 271/272

(58) Field of Classification Search ..... 271/272, 271/273, 274; 399/367–375
See application file for complete search history.

(56) References Cited

U.S. PATENT DOCUMENTS 5,661,573 A * 8/1997 Takehara et al. ..... 358/498
6,102,388 A * 8/2000 Thornhill ..... 271/119
7,080,836 B2 * 7/2006 Hamada et al. ..... 271/274
7,355,763 B2 * 4/2008 Furihata ..... 358/474
2005/0012264 A1 * 1/2005 Morrison et al. ..... 271/274
2007/0018387 A1 * 1/2007 Yamamoto ..... 271/272
2007/0045945 A1 * 3/2007 Iwago ..... 271/272
2007/0069456 A1 * 3/2007 Jeong ..... 271/272

FOREIGN PATENT DOCUMENTS

JP 57175640 A * 10/1982
JP 04072246 A * 3/1992

* cited by examiner

*Primary Examiner*—Patrick Mackey
*Assistant Examiner*—Jeremy Severson
(74) *Attorney, Agent, or Firm*—Kirton & McConkie; Evan R. Witt

(57) ABSTRACT

A paper guide adjusting mechanism of an office machine includes a main body, a plurality of elastic elements, a transmission member, a plurality of fixing elements and a pressing plate. The main body includes a plurality of confining elements, which have respective recess structures. The transmission member includes a roller axle and a plurality of rollers, wherein the roller axle is partially received in the recess structures and the rollers are sheathed around the roller axle. The fixing elements are disposed in respective recess structures of the confining elements, wherein each fixing element has a base and the base has a first surface sustained against a corresponding elastic element and a second surface sustained against the roller axle. The pressing plate is sustained against the elastic elements.

14 Claims, 10 Drawing Sheets

232

PAPER GUIDE ADJUSTING MECHANISM AND OFFICE MACHINE USING SUCH MECHANISM

FIELD OF THE INVENTION

The present invention relates to a paper guide adjusting mechanism, and more particularly to a paper guide adjusting mechanism of an automatic document feeder and an office machine using such a mechanism.

BACKGROUND OF THE INVENTION

With increasing power of personal computers, a diversity of office machines can be employed with the personal computers to achieve various purposes. The diverse office machines, however, occupy lots of space. A multifunction peripheral having multiple functions in one structural unit, for example the functions of a printer, a scanner, a fax machine and/or a copy machine, is thus developed. As a consequence, the processing capability of the multifunction peripheral is increased and the operative space thereof is reduced.

Nowadays, the printer, a scanner, a fax machine, a copy machine or the multifunction peripheral usually has an automatic document feeder for successively and continuously feeding many paper sheets. After a stack of papers to be scanned are placed on the sheet input tray of the automatic document feeder, the sheet-feeding mechanism of the automatic document feeder will successively transport the paper sheets into the inner portion of the office machine so as to implement associated operations such as scanning, faxing, scanning operations and the like.

Referring to FIG. 1, a schematic cross-sectional view of a conventional automatic document feeder for use with an office machine is illustrated. The automatic document feeder 10 of FIG. 1 principally includes a casing 11, a paper-feeding mechanism 12, a transfer module 13, an ejection module 14, a paper input tray 15 and a paper ejecting tray 16. After a stack of paper sheets 151 to be scanned are placed on the paper input tray 15, the paper-feeding mechanism 12 may successively pick the uppermost paper sheets one by one into the passageway within the automatic document feeder 10. In addition, the pick-up module 12 has a stopping plate 121, which is sustained against the front edges of the stack of paper sheets 151, for facilitating smoothly transporting the paper sheets 151 into the paper feeding port. The office machine further includes an image processing module 3 and a glass platform 4 under the automatic document feeder 10.

After a stack of paper sheets 151 to be scanned are placed on the paper input tray 15, the paper-feeding mechanism 12 may successively pick the uppermost paper sheets one by one into the passageway within the automatic document feeder 10. Next, the paper sheet 151 is transported through the transfer channel 133 by the paper guide members 131 and 132 of the transfer module 13. Once the paper sheet 151 is transported across the glass platform 4, a first side of the paper sheet 151 is scanned by the image processing module 3. The paper sheet 151 whose first side has been scanned is then ejected to the paper ejecting tray 16 by the ejection module 14. For a purpose of performing a duplex scanning operation, the transfer module 13 further includes an inverting member 134 adjacent to the ejection module 14. After the first side of the paper sheet 151 has been scanned and a majority of the paper sheet 151 is ejected to the paper ejecting tray 16, the paper sheet 151 is turned over by the inverting member 134 and then fed into the passageway. Next, the paper sheet 151 is transported through the transfer channel 133 by the paper guide members 131 and 132 of the transfer module 13. Once the paper sheet 151 is transported across the glass platform 4, a second side of the paper sheet 151 is scanned by the image processing module 3.

Referring to FIGS. 2(*a*) and 2(*b*), schematic cross-sectional views of the paper guide member 131 of the transfer module 13 are illustrated. The paper guide member 131 includes a pressing plate 1311, a plurality of springs 1312, a plurality of rollers 1313 and a roller axle 1314. The rollers 1313 are sheathed around and secured to the roller axle 1314. For each roller 1313, two springs 1312 are respectively arranged at bilateral sides thereof. A first end of the spring 1312 is sustained against the roller axle 1314. A second end of the spring 1312 is sustained against the pressing plate 1311. During the rollers 1313 are rotated to guide and transport the paper sheet 151, the roller axle 1314 is rotated with the rollers 1313 in the same direction. Since the diameter of the roller 1313 is greater than that of the roller axle 1314, the center of the roller axle 1314 will be shifted when the rollers 1313 are rotated. For example, when the rollers 1313 are rotated in the anti-clockwise direction, the center of the roller axle 1314 may be shifted from the position A as shown in FIG. 2(*a*) to the left position B as shown in FIG. 2(*b*). Since the spring 1312 is sustained against the roller axle 1314, the contact surface of the roller axle 1314 is arc-shaped. Due to the arc-shaped contact surface of the roller axle 1314, the spring 1312 is readily aslant if the force exerted thereon is not even. Under this circumstance, the forces exerted on bilateral sides of the roller 1313 are also uneven and thus the paper sheet 151 is usually aslant upon being guided by the paper guide member 131.

Especially when a duplex scanning operation or a double-side printing operation is performed, the paper sheet 151 is turned over by the inverting member 134 and then fed into the passageway. Next, the paper sheet 151 is transported through the transfer channel 133 by the transfer module 13. If no additional means is used to correct the aslant paper sheet 151, the image quality of the paper sheet after scanned by the reading line of the image processing module 3 is reduced.

In views of the above-described disadvantages resulted from the conventional mechanism, the applicant keeps on carving unflaggingly to develop a paper guide adjusting mechanism and an office machine using such a mechanism according to the present invention through wholehearted experience and research.

SUMMARY OF THE INVENTION

It is an object of the present invention to provide a paper guide adjusting mechanism for minimizing occurrence of the aslant paper sheet and thus enhancing the image quality.

Another object of present invention to provide an office machine having such a paper guide adjusting mechanism.

In accordance with an aspect of the present invention, there is provided a paper guide adjusting mechanism of an office machine. The paper guide adjusting mechanism includes a main body, a plurality of elastic elements, a transmission member, a plurality of fixing elements and a pressing plate. The main body includes a plurality of confining elements, which have respective recess structures. The transmission member includes a roller axle and a plurality of rollers, wherein the roller axle is partially received in the recess structures and the rollers are sheathed around the roller axle. The fixing elements are disposed in respective recess structures of the confining elements, wherein each fixing element has a base and the base has a first surface sustained against a corresponding elastic element and a second surface sustained against the roller axle. The pressing plate is sustained against the elastic elements. When the roller axle is rotated with the rollers in the same direction, a force generated by the elastic element is uniformly distributed and downwardly transmitted to permit shift of the roller axle in the recess structures, thereby smoothly guiding a paper sheet into a transfer channel of the office machine.

In accordance with another aspect of the present invention, there is provided an office machine. The office machine includes a glass platform, an image processing module and an automatic document feeder. The image processing module is arranged under the glass platform. The automatic document feeder includes a paper guide adjusting mechanism. The paper guide adjusting mechanism includes a main body, a plurality of elastic elements, a transmission member, a plurality of fixing elements and a pressing plate. The main body includes a plurality of confining elements, which have respective recess structures. The transmission member includes a roller axle and a plurality of rollers, wherein the roller axle is partially received in the recess structures and the rollers are sheathed around the roller axle. The fixing elements are disposed in respective recess structures of the confining elements, wherein each fixing element has a base and the base has a first surface sustained against a corresponding elastic element and a second surface sustained against the roller axle. The pressing plate is sustained against the elastic elements. When the roller axle is rotated with the rollers in the same direction, a force generated by the elastic element is uniformly distributed and downwardly transmitted to permit shift of the roller axle in the recess structures, thereby smoothly guiding a paper sheet into a transfer channel of the office machine.

The above contents of the present invention will become more readily apparent to those ordinarily skilled in the art after reviewing the following detailed description and accompanying drawings, in which:

BRIEF DESCRIPTION OF THE DRAWINGS

FIG. 6(*b*) is a schematic cross-sectional view illustrating the paper guide adjusting mechanism shown in FIG. 4, in which the roller is rotated in the anti-clockwise direction;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
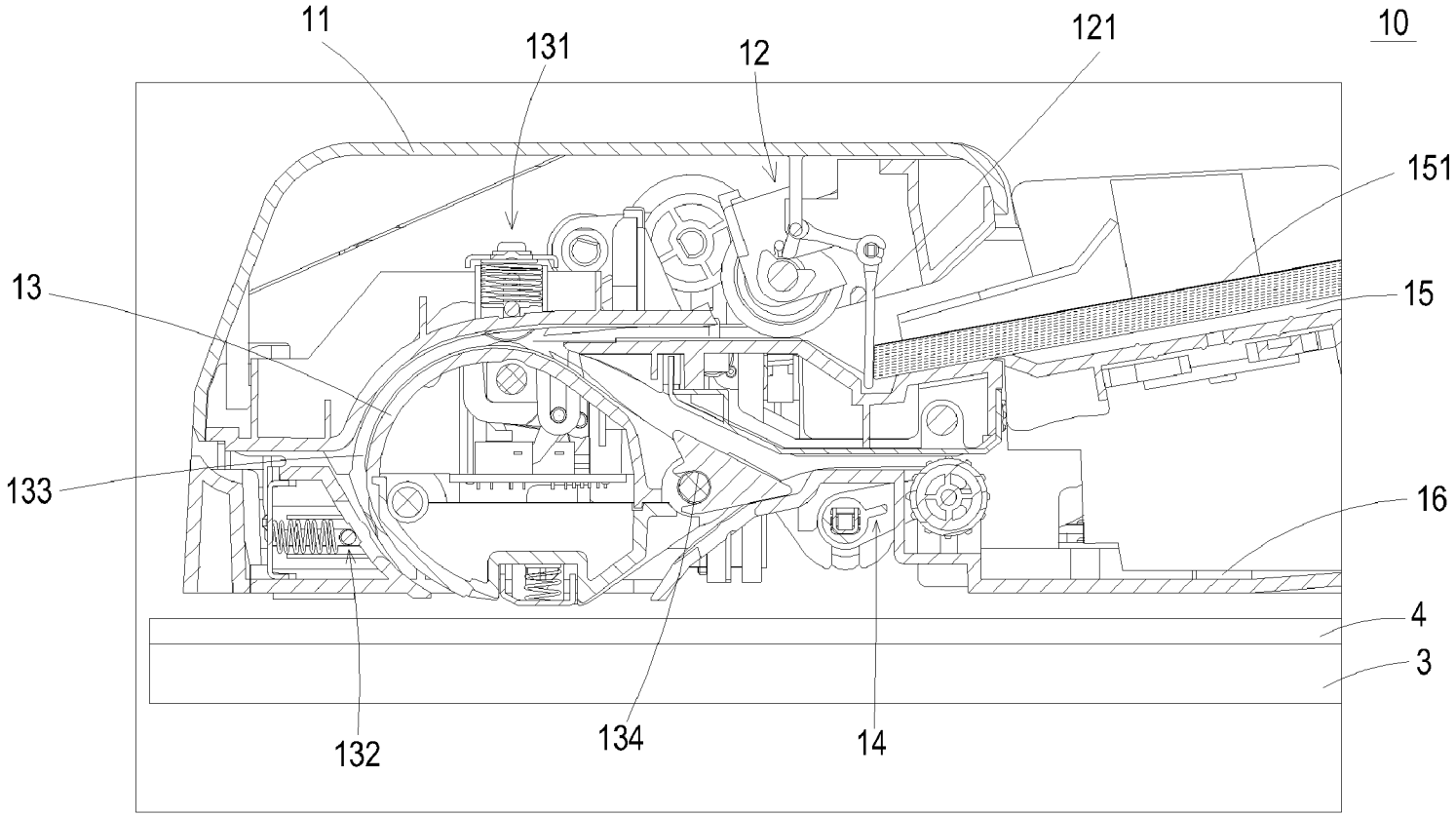
Fig. 1 Prior Art
FIG. 1 is a schematic cross-sectional view of a conventional automatic document feeder for use with an office machine.
Figure 2A:
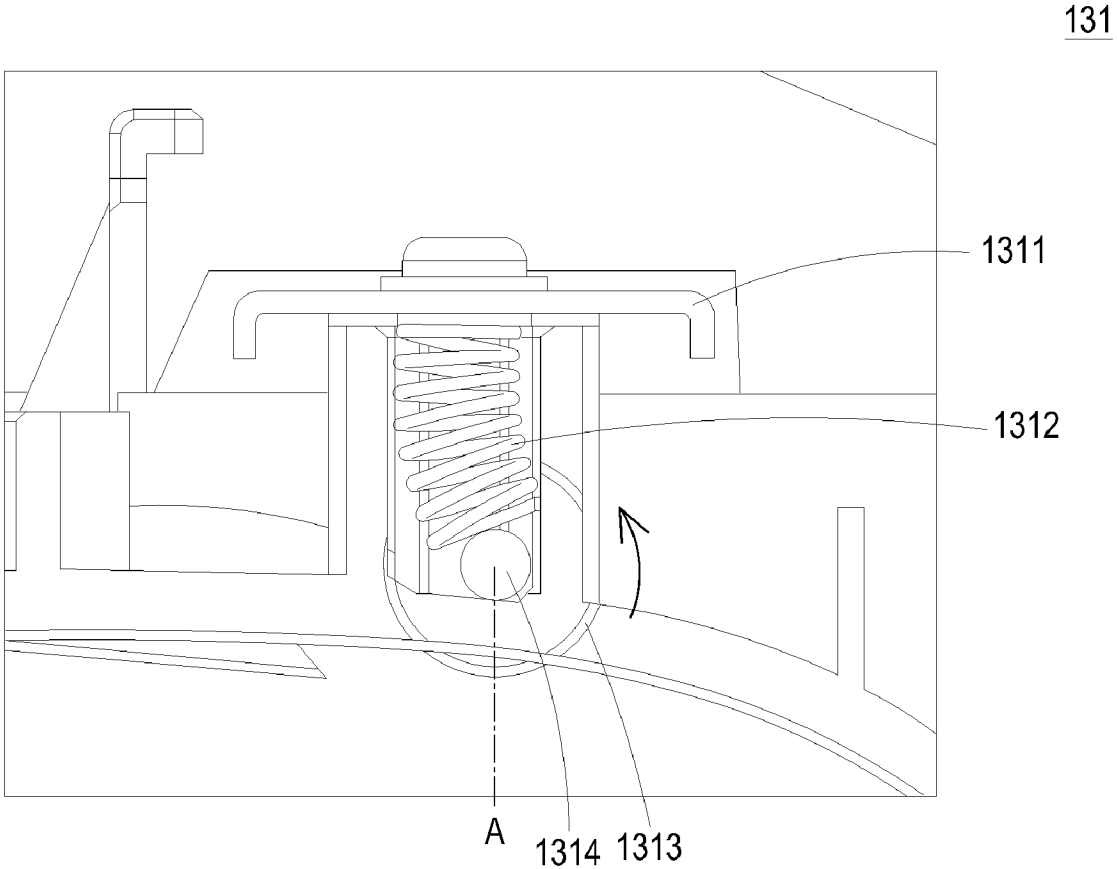
Fig. 2(a) Prior Art
FIGS. 2(*a*) and 2(*b*) are schematic cross-sectional views illustrating the paper guide member shown in FIG. 1, in which the center of the roller axle is shifted between the position A and position B.
Figure 2B:
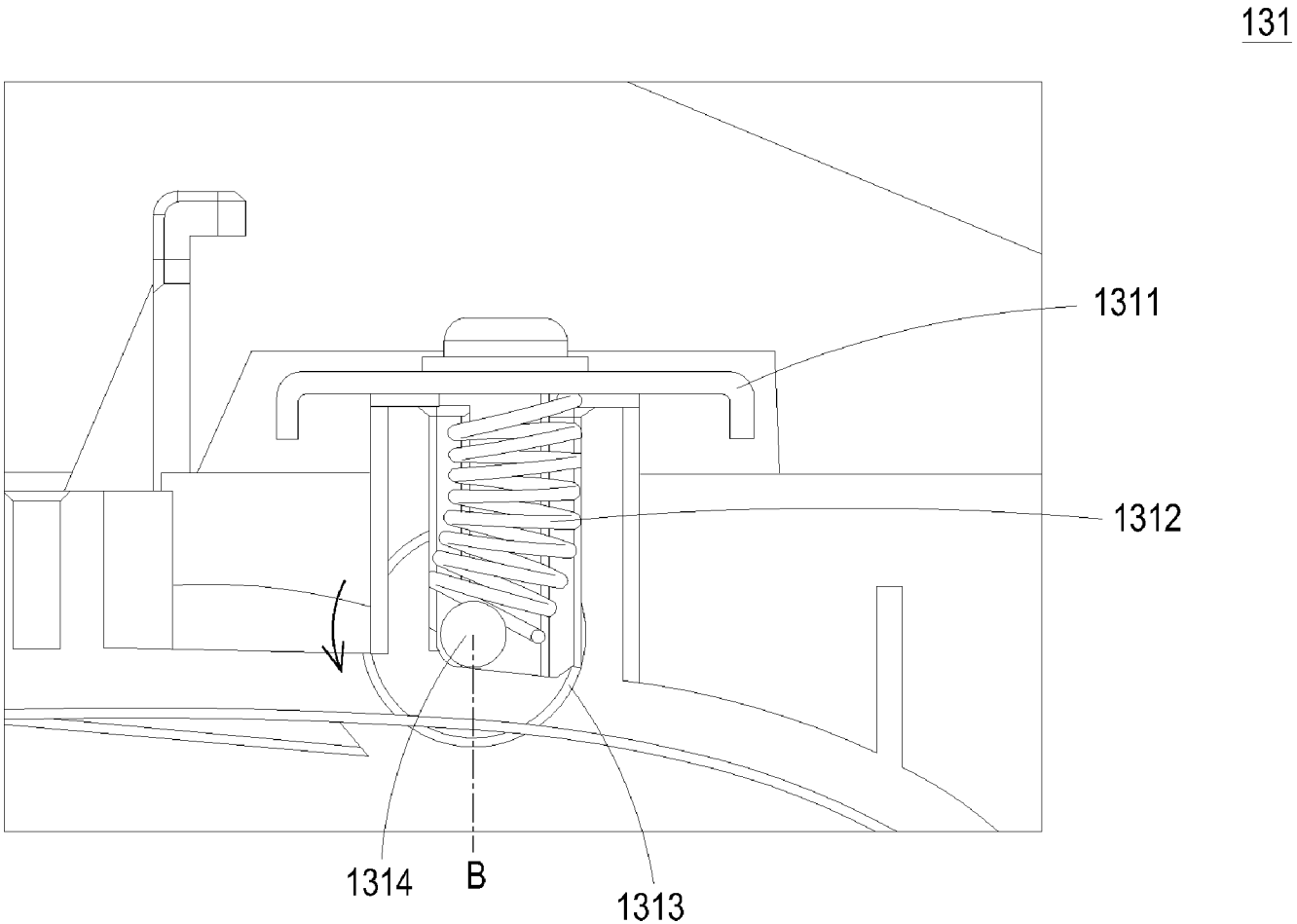
Fig. 2(b) Prior Art
Figure 3:
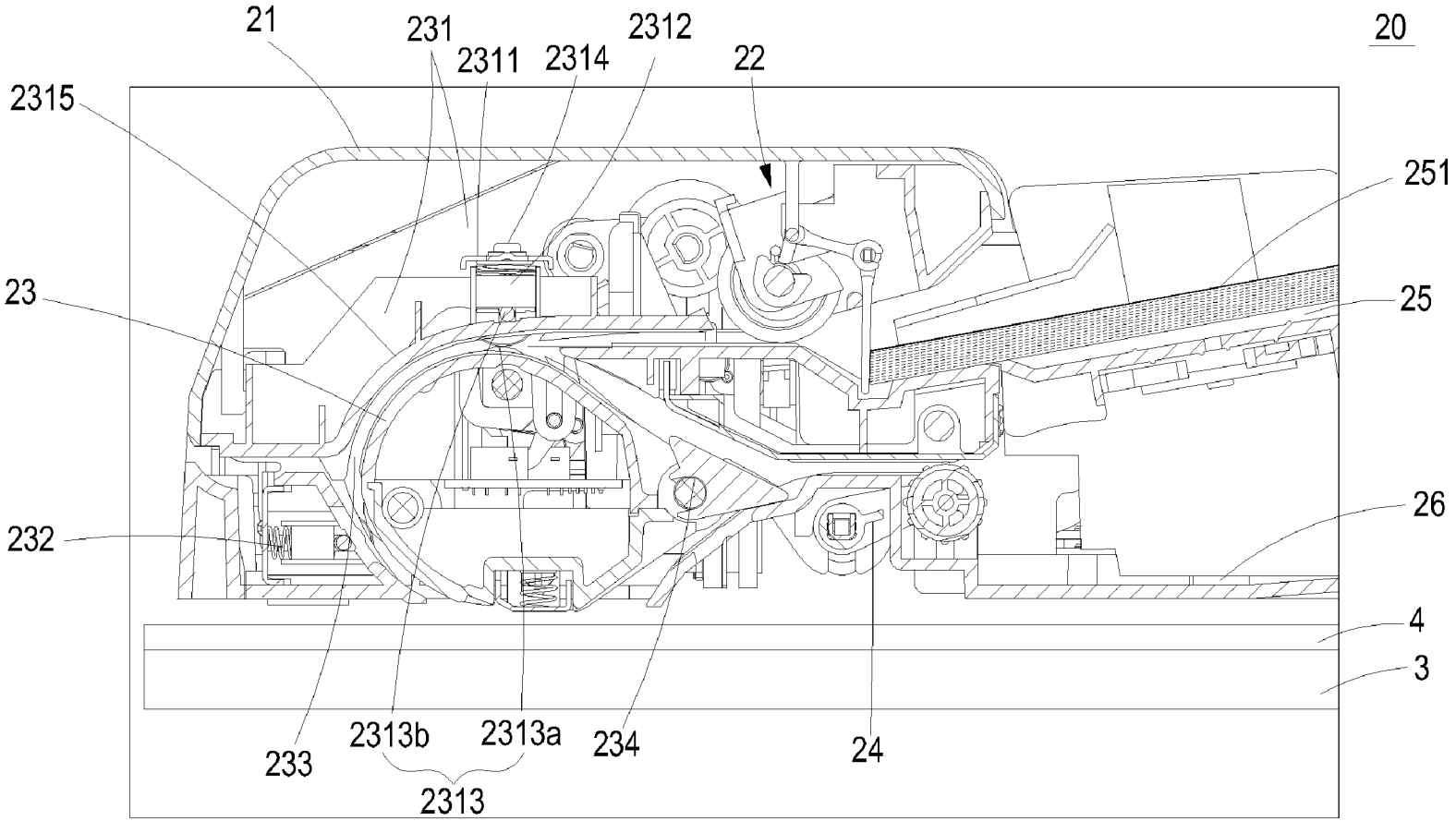
FIG. 3 is a schematic cross-sectional view of an automatic document feeder for use with an office machine according to a preferred embodiment of the present invention.

Referring to FIG. 3, a schematic cross-sectional view of an automatic document feeder for use with an office machine according to a preferred embodiment of the present invention is illustrated. The office machine of the present invention includes but is not limited to a printer, a scanner, a fax machine, a copy machine or a multifunction peripheral. Hereinafter, the present invention is illustrated by referring to a scanner or a printer. As shown in FIG. 3, the automatic document feeder 20 principally includes a casing 21, a paper-feeding mechanism 22, a transfer module 23, an ejection module 24, a paper input tray 25 and a paper ejecting tray 26. The office machine further includes an image processing module 3 and a glass platform 4 under the automatic document feeder 20. After a stack of paper sheets 251 to be scanned are placed on the paper input tray 25, the paper-feeding mechanism 22 may successively pick the uppermost paper sheets one by one into the passageway within the automatic document feeder 20.

The transfer module 23 includes paper guide adjusting mechanisms 231 and 232, a transfer channel 233 and an inverting member 234. After the uppermost paper sheet is fed one by one into the passageway within the automatic document feeder 20, the paper sheet 251 is transported through the transfer channel 233 by the paper guide adjusting mechanisms 231 and 232 of the transfer module 23. Once the paper sheet 251 is transported across the glass platform 4, a first side of the paper sheet 251 is scanned by the image processing module 3. The paper sheet 251 whose first side has been scanned is then ejected to the paper ejecting tray 26 by the ejection module 24. The inverting member 234 is disposed adjacent to the ejection module 24 for performing a duplex scanning operation. After the first side of the paper sheet 251 has been scanned and a majority of the paper sheet 251 is ejected to the paper ejecting tray 26, the paper sheet 251 is turned over by the inverting member 234 and then fed into the passageway. Next, the paper sheet 251 is transported through the transfer channel 233 by the paper guide adjusting mechanisms 231 and 232 of the transfer module 23. Once the paper sheet 251 is transported across the glass platform 4, a second side of the paper sheet 251 is scanned by the image processing module 3.

Figure 4:
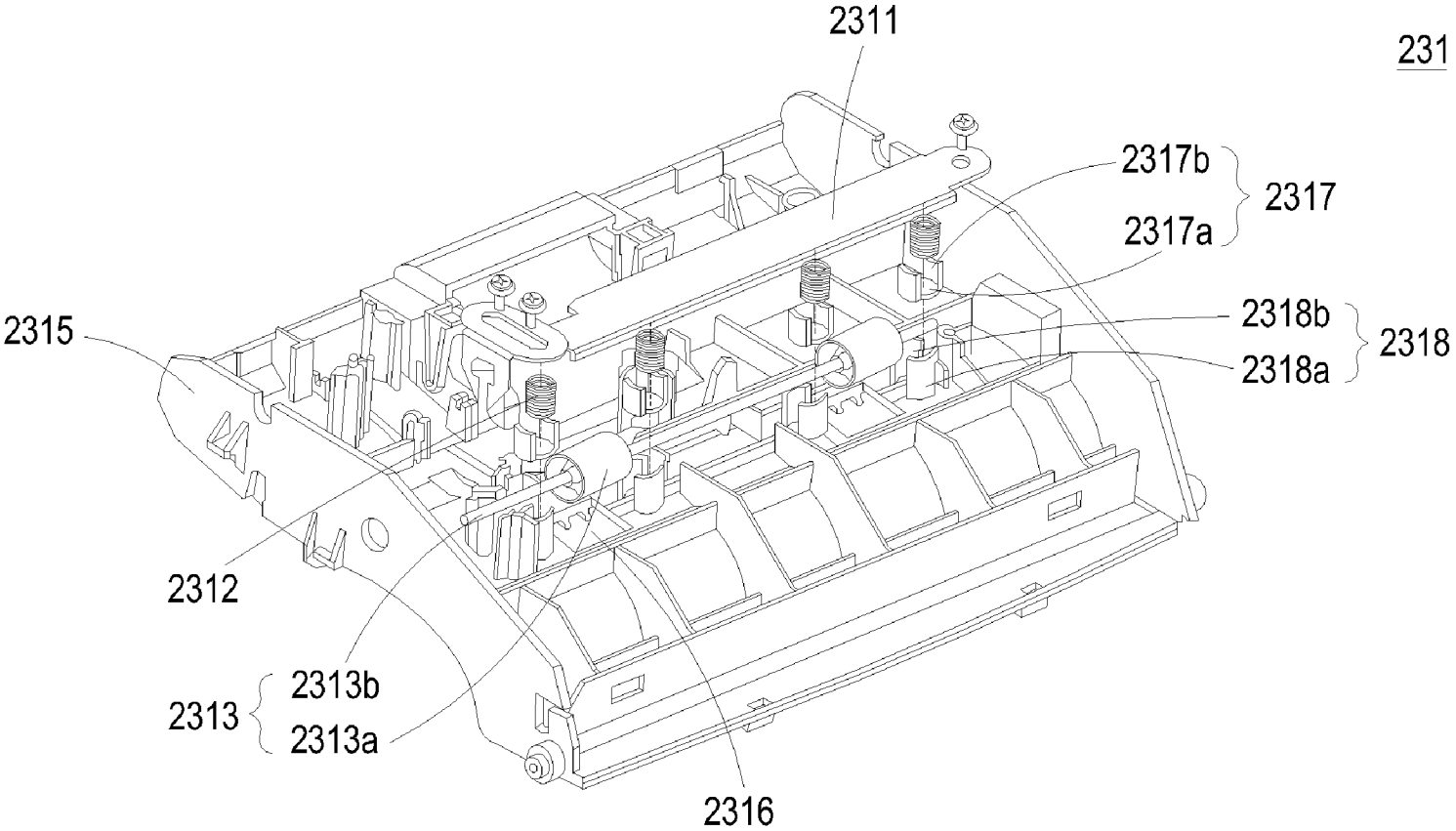
FIG. 4 is a schematic exploded view of a paper guide member used in the automatic document feeder of FIG. 3.

Referring to FIG. 4, a schematic exploded view of a paper guide member 231 used in the automatic document feeder of FIG. 3 is illustrated. As shown in FIGS. 3 and 4, the paper guide member 231 includes a pressing plate 2311, a plurality of elastic elements 2312 (e.g. springs), a transmission member 2313, a main body 2315 of the transfer module 23 and a plurality of fixing elements 2317. The transmission member 2313 includes a plurality of rollers 2313*a* and a roller axle 2313*b*. These rollers 2313*a* are sheathed around the roller axle 2313*b*. In addition, a plurality of confining elements 2318 are arranged on the main body 2315 of the transfer module 23 for confining the roller axle 2313*b* and the elastic elements 2312 in position. A plurality of slots 2316 are formed in the main body 2315 at the locations corresponding to the rollers 2313*a*. In addition, each slot 2316 is located between every two adjacent confining elements 2318. The rollers 2313*a* are partially embedded into corresponding slots 2316 such that the rollers 2313*a* may be in contact with the paper sheet 251 (as shown in FIG. 3) through the slots 2316 to guide the paper sheet 251. In some embodiments, these confining elements 2318 are integrally formed on the main body 2315. In this embodiment, each confining element 2318 includes two separate curved plates 2318*a*. A gap is formed between these two curved plates 2318*a* to define a recess structure 2318*b*, which is substantially parallel to the roller axle 2313*b*. After the roller axle 2313*b* is received within the recess structures 2318*b* of these confining elements 2318, the fixing elements 2317 and the elastic elements 2312 may be successively received within the recess structures 2318*b*.

Figure 5:
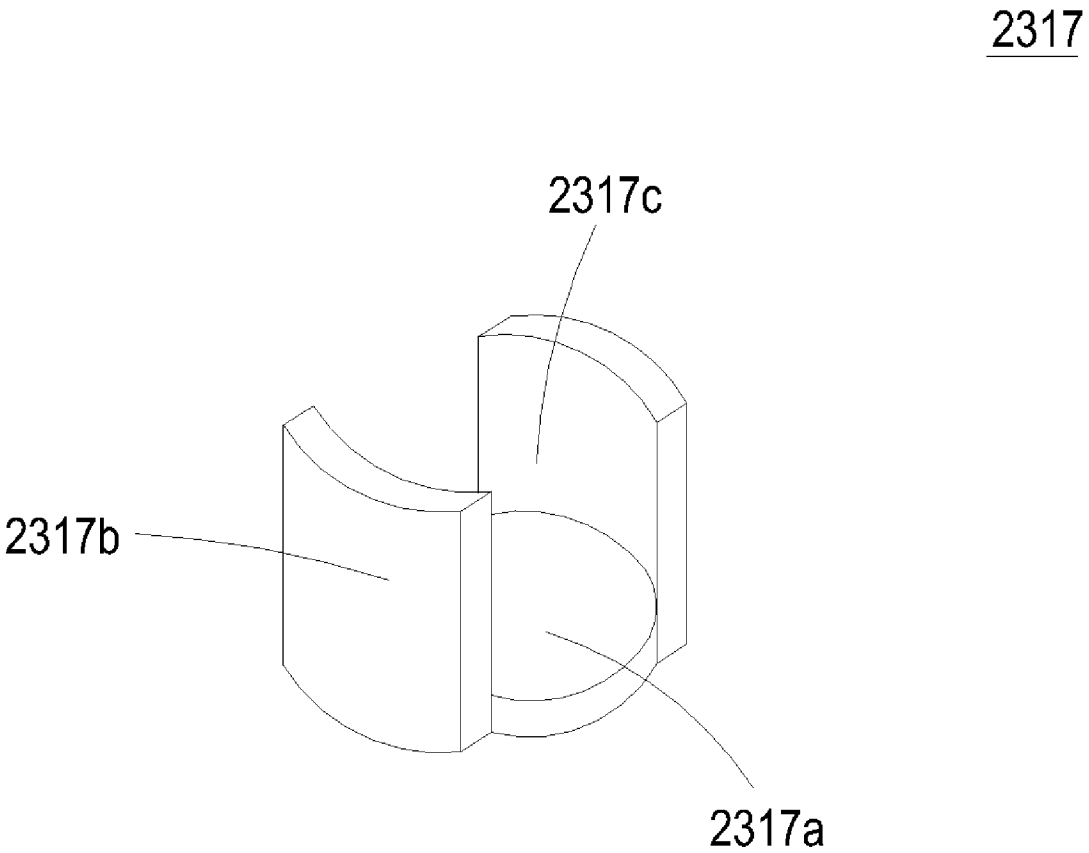
FIG. 5 is a schematic perspective view of a fixing element used in the paper guide member of FIG. 4.

FIG. 5 is a schematic perspective view of a fixing element 2317 used in the paper guide member 231. Please refer to FIG. 4 and FIG. 5. The fixing element 2317 includes a base 2317*a* and two separate curved slices 2317*b*. The base 2317*a* has a first surface and a second surface contacted with a corresponding elastic element 2312 and the roller axle 2313*b*, respectively. Preferably, the first surface and the second surface of the base 2317*a* are flat in order to facilitate uniformly distributing and downwardly transmitting the force generated by the elastic element 2312. As a consequence, the elastic element 2312 and the roller axle 2313*b* are securely sustained against the base 2317*a*, thereby minimizing occurrence of the aslant elastic element 2312. In some embodiments, the separate curved slices 2317*b* are protruded from peripheral of the base 2317*a* such that a receptacle 2317*c* is defined by the curved slices 2317*b* for accommodating the elastic element 2312 therein. Moreover, the receptacle 2317*c* of the fixing element 2317 is substantially aligned with the recess structure 2318*b* of a corresponding confining element 2318. After the roller axle 2313*b* is received within the recess structures 2318*b* of the confining elements 2318, the fixing elements 2317 will be also received within the recess structures 2318*b* of respective confining elements 2318 and the curved slices 2317*b* of the fixing elements 2317 are clamped by the curved plates 2318*a* of the confining elements 2318. Since the gap between the two curved slices 2317*b* of each fixing element 2317 is perpendicular to the roller axle 2313*b*, the receptacle 2317*c* of the fixing element 2317 may be shielded by the curved plates 2318*a* of the corresponding confining element 2318. As a consequence, the elastic elements 2312 are firmly accommodated within the receptacles 2317*c* of respective fixing elements 2317. In addition, the roller axle 2313*b* is arranged between the confining elements 2318 and the fixing elements 2317 (see FIG. 6 (*a*)). Meanwhile, the corresponding elastic element 2312 and the roller axle 2313*b* are contacted with the first surfaces and the second surfaces of the bases 2317*a* of the fixing elements 2317, respectively.

Figure 6A:
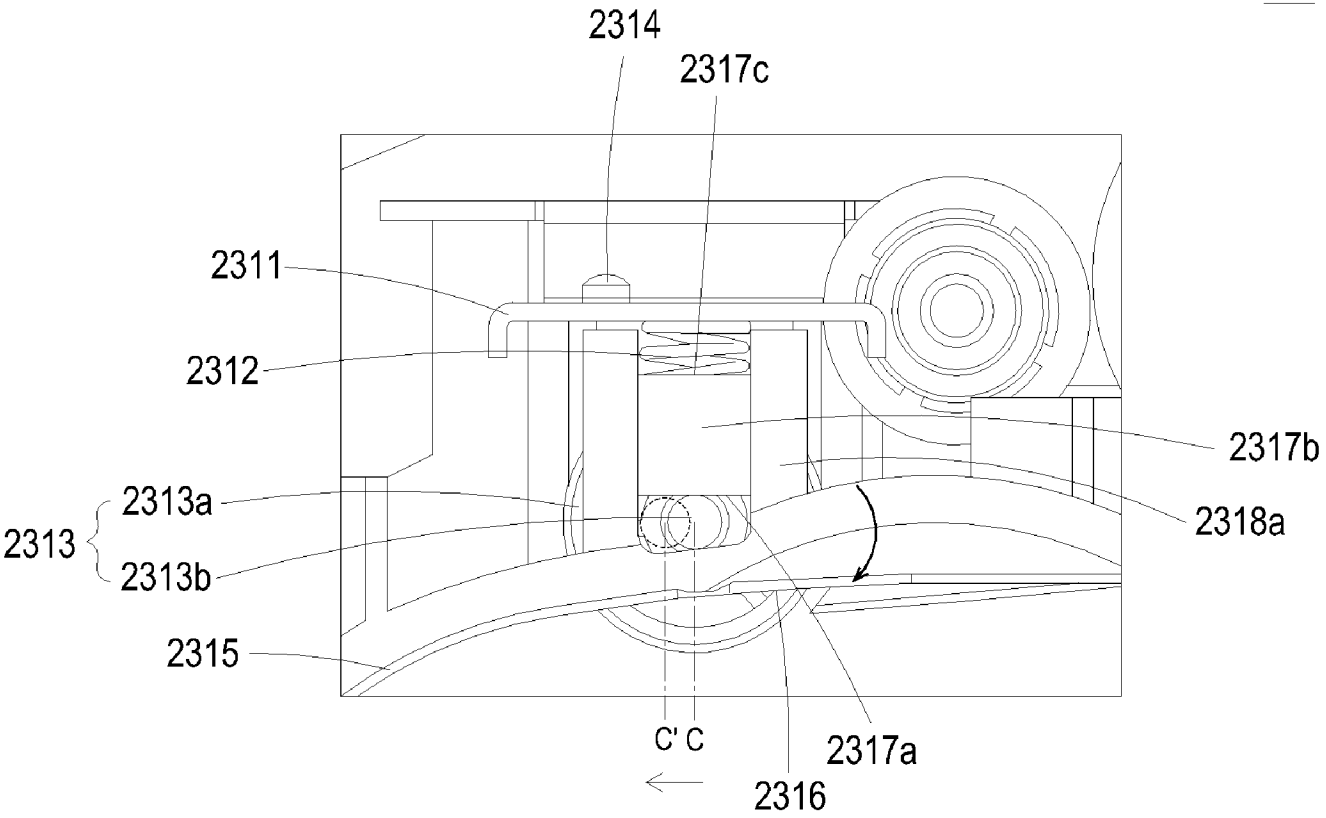
FIG. 6(*a*) is a schematic cross-sectional view illustrating the paper guide adjusting mechanism shown in FIG. 4, in which the roller is rotated in the clockwise direction.
Figure 6B:
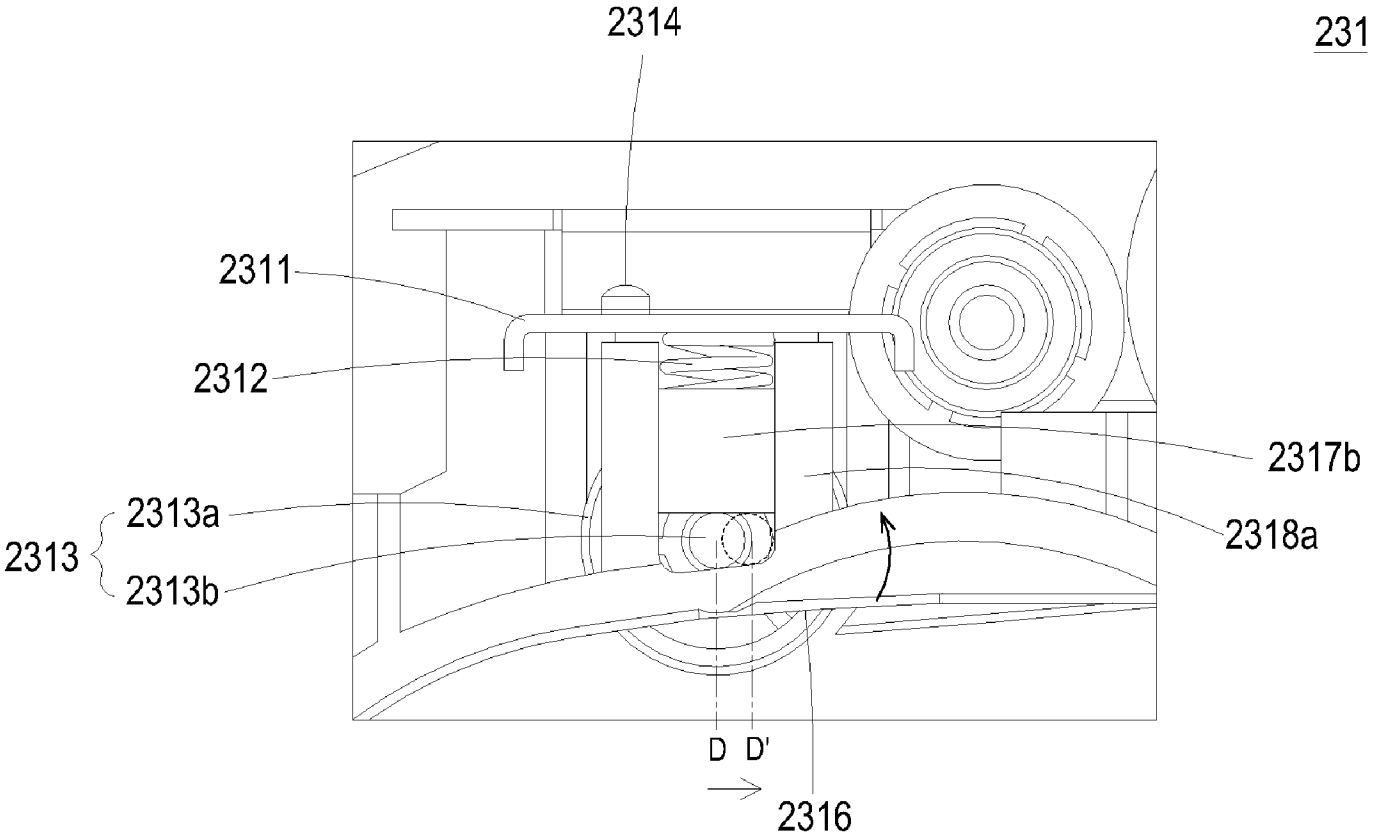

Please refer to FIGS. 6(*a*) and 6(*b*), which are schematic views illustrating actions of the rollers 2313*a*. Hereinafter, a process of assembling the paper guide member 231 will be illustrated with reference to FIG. 4 and FIGS. 6(*a*) and 6(*b*). First of all, the roller axle 2313*b* is mounted on the main body 2315 and partially received within the recess structures 2318*b* of these confining elements 2318. The rollers 2313*a* are partially embedded into corresponding slots 2316 such that the rollers 2313*a* may be in contact with the paper sheet 251 through the slots 2316. Next, the fixing elements 2317 are received within the recess structures 2318*b* of respective confining elements 2318, in which the curved slices 2317*b* of the fixing elements 2317 are clamped by the curved plates 2318*a* of the confining elements 2318 to enclose the receptacles 2317*c*. Next, the elastic elements 2312 are accommodated within the receptacles 2317*c* of respective fixing elements 2317. Afterwards, the pressing plate 2311 is placed on the elastic elements 2312 and then fixed on the main body 2315 via fastening elements 2314 (e.g. screws). Meanwhile, the paper guide member 231 has been assembled.

Once the roller 2313*a* is rotated in the clockwise direction, as is shown in FIG. 6(*a*), the center of the roller axle 2313*b* is shifted from the position C to the position C'. Whereas, once the roller 2313*a* is rotated in the anti-clockwise direction, as is shown in FIG. 6(*b*), the center of the roller axle 2313*b* is shifted from the position D to the position D'. No matter how the roller axle 2313*b* is shifted, the elastic element 2312 will no longer be aslant because the flat surfaces of the base 2317*a* between the elastic element 2312 and the roller axle 2313*b* are firmly sustained against the elastic element 2312 and the roller axle 2313*b*. As a consequence, the elastic element 2312 will not be aslant or deviated. Moreover, since the elastic element 2312 is confined in the receptacle 2317*c* defined by the curved slices 2317*b* and the curved plates 2318*a* of the confining elements 2318 of the confining element 2318, the force generated by the elastic element 2312 will be uniformly distributed and downwardly transmitted to the roller axle 2313*b*. As a consequence, the paper sheet 251 will be smoothly guided by the paper guide adjusting mechanism of the present invention without being aslant or deviated.

Figure 7:
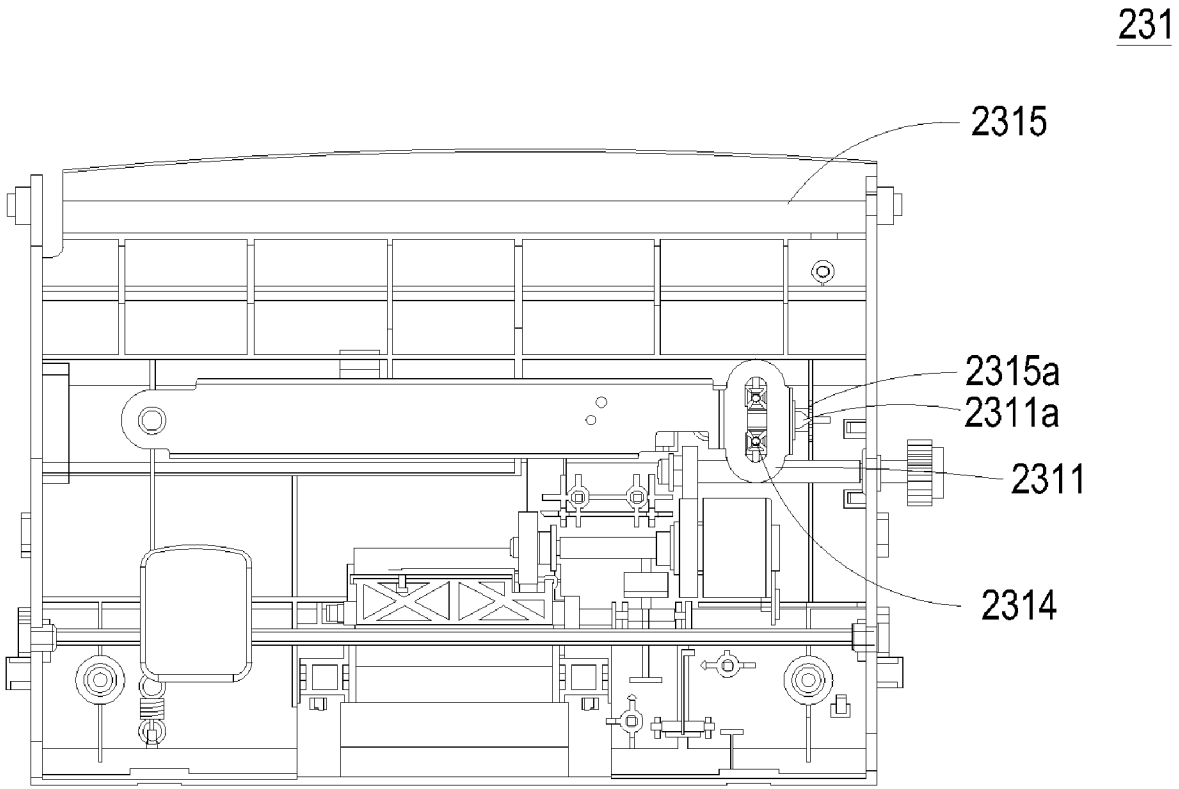
FIG. 7 is a top view illustrating the paper guide member of FIG. 4.

Please refer to FIG. 7, which is a top view illustrating the paper guide member of FIG. 4. As shown in FIG. 7, a first end of the pressing plate 2311 is fixed on the main body 2315 and a second end of the pressing plate 2311 is pivotal about the first end. In addition, the main body 2315 has graduations 2315*a* beside the second end of the pressing plate 2311. The second end of the pressing plate 2311 has an indicator 2311*a* pointing to one of the graduations 2315*a*. By referring to the graduation 2315*a* pointed by the indicator 2311*a*, the advancing angle of the paper sheet 251 is tuned and then detected by imaging software (not shown). Once an optimal advancing angle of the paper sheet 251 is obtained, the second end of the pressing plate 2311 is fixed on the main body 2315 via the fastening elements 2314 (e.g. screws). Meanwhile, the paper sheet 251 will be smoothly guided by the paper guide adjusting mechanism 231 to transport through the transfer channel 233 and then scanned by the images image processing module 3, thereby achieving a sharper image.

Figure 8:
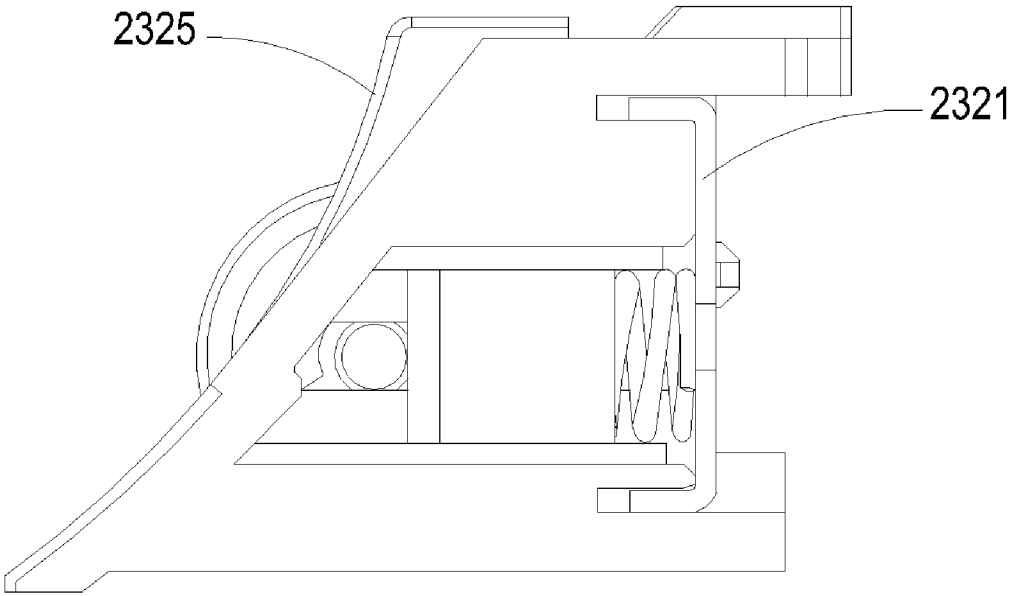
FIG. 8 is a schematic exploded view of another paper guide member used in the automatic document feeder of FIG. 3.

The above embodiments are illustrated by referring to the paper guide adjusting mechanism 231. The operation principles and the configurations of the paper guide adjusting mechanism 232 is substantially identical to those of the paper guide adjusting mechanism 231, and are not redundantly described herein. In addition, the main body 2325 of the paper guide adjusting mechanism 232 has an arc-shaped surface, as can be seen in FIG. 8. Since the paper sheet 251 has been smoothly guided by the paper guide adjusting mechanism 231, the pressing plate 2321 of the paper guide adjusting mechanism 232 may be fixed on the main body 2325. Alternatively, the location of the paper guide adjusting mechanism 232 may be varied and the advancing angle of the paper sheet 251 may be tuned according to the manufactures' design.

From the above description, since the base of the fixing element has flat surfaces, the force generated by the elastic element may be uniformly distributed so as to minimize occurrence of the aslant elastic element. As a consequence, the paper sheet will be smoothly guided by the paper guide adjusting mechanism of the present invention and thus the image quality of the paper sheet after scanned by the reading line of the image processing module is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper guide adjusting mechanism of an office machine, comprising:

a main body including a plurality of confining elements, which have respective recess structures;

a plurality of elastic elements;

a transmission member including a roller axle and a plurality of rollers, wherein said roller axle is partially received in said recess structures and said rollers are sheathed around said roller axle;

a plurality of fixing elements disposed in respective recess structures of said confining elements, wherein each fixing element has a base and said base has a first surface sustained against a corresponding elastic element and a second surface sustained against said roller axle; and a pressing plate sustained against said elastic elements, wherein said pressing plate has a first end fixed on said main body and a second end being pivotable about said first end, said main body has graduations beside said second end of said pressing plate, and said second end of said pressing plate has an indicator pointing to one of said graduations;

wherein a force generated by said elastic element is uniformly distributed and downwardly transmitted to permit shift of said roller axle in said recess structures when said roller axle is rotated with said rollers in the same direction, thereby smoothly guiding a paper sheet into a transfer channel of said office machine.

2. The paper guide adjusting mechanism according to claim 1 wherein each of said confining elements includes two separate curved plates cooperatively defining said recess structure, thereby confining shift of said roller axle in the advancing direction of said paper sheet.

3. The paper guide adjusting mechanism according to claim 1 wherein a plurality of slots are formed in said main body at the locations corresponding to said rollers, and said rollers are partially embedded into corresponding slots.

4. The paper guide adjusting mechanism according to claim 3 wherein said slots are located between every two adjacent confining elements.

5. The paper guide adjusting mechanism according to claim 1 wherein said elastic elements are springs.

6. The paper guide adjusting mechanism according to claim 1 wherein each of said fixing elements includes two separate curved slices cooperatively defining a receptacle for receiving a corresponding elastic element therein.

7. The paper guide adjusting mechanism according to claim 1 wherein a first end and a second end of said pressing plate are fixed on said main body.

8. An office machine, comprising:

a glass platform;

an image processing module arranged under said glass platform; and an automatic document feeder including a paper guide adjusting mechanism, said paper guide adjusting mechanism comprising:

a main body including a plurality of confining elements, which have respective recess structures;

a plurality of elastic elements;

a transmission member including a roller axle and a plurality of rollers, wherein said roller axle is partially received in said recess structures and said rollers are sheathed around said roller axle;

a plurality of fixing elements disposed in respective recess structures of said confining elements, wherein each fixing element has a base and said base has a first surface sustained against a corresponding elastic element and a second surface sustained against said roller axle; and a pressing plate sustained against said elastic elements, wherein said pressing plate has a first end fixed on said main body and a second end being pivotable about said first end, said main body has graduations beside said second end of said pressing plate, and said second end of said pressing plate has an indicator pointing to one of said graduations;

wherein a force generated by said elastic element is uniformly distributed and downwardly transmitted to permit shift of said roller axle in said recess structures when said roller axle is rotated with said rollers in the same direction, thereby smoothly guiding a paper sheet into a transfer channel of said office machine.

9. The office machine according to claim 8 wherein each of said confining elements includes two separate curved plates cooperatively defining said recess structure, thereby confining shift of said roller axle in the advancing direction of said paper sheet.

10. The office machine according to claim 8 wherein a plurality of slots are formed in said main body at the locations corresponding to said rollers, and said rollers are partially embedded into corresponding slots.

11. The office machine according to claim 10 wherein said slots are located between every two adjacent confining elements.

12. The office machine according to claim 8 wherein said elastic elements are springs.

13. The office machine according to claim 8 wherein each of said fixing elements includes two separate curved slices cooperatively defining a receptacle for receiving a corresponding elastic element therein.

14. The office machine according to claim 8 wherein a first end and a second end of said pressing plate are fixed on said main body.

* * * * *